US006117028A

United States Patent [19]

You

[11] Patent Number: 6,117,028

[45] Date of Patent: Sep. 12, 2000

[54] SHOCK ABSORBING DEVICE FOR USE IN BALLGAME GOODS HAVING TUBULAR ROD-SHAPED BODY

[76] Inventor: Chin-San You, No. 6, Lane 477, Sec. 2, Feng-Shyn Rd., Feng Yuan City, Taichung Hsien, Taiwan

[21] Appl. No.: 09/215,215

[22] Filed: Dec. 18, 1998

[51] Int. Cl.[7] ..... A63B 49/00; A63B 53/00; A63B 59/00

[52] U.S. Cl. ..... 473/520; 473/521; 473/559; 473/297; 473/318

[58] Field of Search ..... 473/520, 521, 473/554, 549, 297, 318

[56] References Cited

U.S. PATENT DOCUMENTS

| | | | |
|---|---|---|---|
| 2,051,083 | 8/1936 | Hart | 473/318 |
| 3,372,932 | 3/1968 | Molis | 473/318 |
| 5,236,198 | 8/1993 | Haines et al. | 473/521 |
| 5,655,980 | 8/1997 | Nashif et al. | 473/520 |
| 5,718,643 | 2/1998 | Wright et al. . | |
| 5,865,694 | 2/1999 | Duong-Van | 473/520 |
| 5,935,027 | 8/1999 | Nashif et al. | 473/521 |

*Primary Examiner*—Raleigh W. Chiu
*Attorney, Agent, or Firm*—Browdy and Neimark

[57] ABSTRACT

A shock-absorbing device is designed for use in ballgame goods having a tubular rod-shaped body and is composed of a tubular body and a weight. The tubular body is made of a soft elastic material. The weight is disposed in the tubular body such that weight is connected with the tubular body, and that an interstice is located between the outer surface of the weight and the inner wall of the tubular body so as to enable the weight to vibrate in the tubular body. The tubular body of the shock-absorbing device is disposed in the inner wall of the tubular rod-shaped body of the ballgame goods. The tubular body is capable of absorbing shock wave of the ballgame goods. The vibrational motion of the weight is capable of canceling shock wave of the ballgame goods.

10 Claims, 6 Drawing Sheets

SHOCK ABSORBING DEVICE FOR USE IN BALLGAME GOODS HAVING TUBULAR ROD-SHAPED BODY

FIELD OF THE INVENTION

The present invention relates generally to a sporting goods, and more particularly to a shock-absorbing means for use in a ballgame goods having a tubular rod-shaped body.

BACKGROUND OF THE INVENTION

There are a variety of ballgames, such as tennis, badminton, squash, golf, baseball, etc., which are all played with a ball along with a sporting goods like racket, club and bat for hitting the ball. Upon being impacted by the ball, the sporting goods is acted on by a reaction force to bring about a shock wave which is transmitted to the hand holding the sporting goods. The shock wave can cause an uncomfortable sensation to the hand and undermine the ability of the hand to hit the ball with precision. The makers of the sporting goods have endeavored to provide the sporting goods with a shock-absorbing means capable of minimizing the effect of the shock wave.

The shock-absorbing mechanisms of the prior art are generally disposed in the handle portion of a sporting goods, such as racket, club, bat, and so forth. Such shock-absorbing mechanisms are disposed such that they are either fixed or movable. The fixed shock-absorbing device is made of a soft material capable of absorbing shock wave. The movable shock-absorbing device is made of a body capable of vibrating to cancel out the shock wave. These two prior art shock-absorbing mechanisms are not effective at best. In addition, the prior art shock-absorbing mechanisms are designed for use in certain specific sporting goods which are used in the ballgame. In other words, the prior art shock-absorbing mechanisms are rather limited in use.

SUMMARY OF THE INVENTION

It is therefore the primary objective of the present invention to provide a shock-absorbing means which is relatively more effective in alleviating the shock wave of the sporting goods of ballgame.

It is another objective of the present invention to provide a shock-absorbing means for use in all forms of ballgame goods having a tubular rod-shaped body.

In keeping with the principle of the present invention, the foregoing objectives of the present invention are attained by a shock-absorbing device consisting of a tubular body of a soft elastic material, and a weight disposed in the tubular body such that the weight is connected with the tubular body, and that there is an interstice between the outer surface of the weight and the inner wall surface of the tubular body, and further that the weight is capable of vibrating in the tubular body.

The shock-absorbing device of the present invention is disposed in the sporting goods such that the tubular body of the device is disposed in the inner wall of the tubular rod-shaped body of the sporting goods for absorbing the shock wave at the time when the sporting goods is impacted on by a ball. The shock wave is canceled out by the weight in vibrational motion.

The foregoing objectives, features, functions, and advantages of the present invention will be more readily understood upon a thoughtful deliberation of the following detailed description of the embodiments of the present invention with reference to the accompanying drawings.

DETAILED DESCRIPTION OF THE INVENTION

Figure 1:
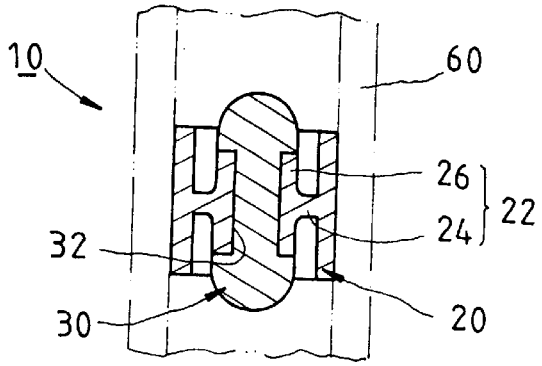
FIG. 1 shows a sectional view of a first preferred embodiment of the present invention.
Figure 2:
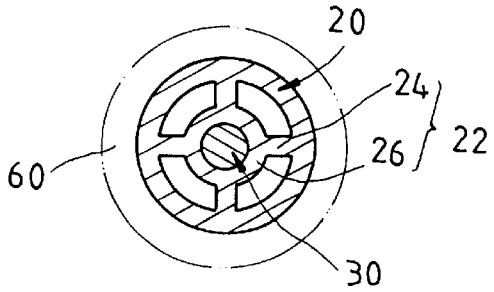
FIG. 2 shows a sectional view of a portion taken in the direction indicated by a line 2—2 as shown in FIG. 1.

As shown in FIGS. 1 and 2, a shock absorbing device 10 of the first preferred embodiment of the present invention is composed of a tubular body 20 and a weight 30.

The tubular body 20 is made of a shock-absorbing material, such as a rubber or foam material. The tubular body 20 is provided in the inner wall thereof with a connection structure 22 consisting of four columnar connection portions 24 which are arranged equidistantly in the inner wall such that they extend radially and inwards. The connection structure 22 further consists of a connection ring 26, which is connected in the periphery thereof with the free ends of the connection portions 24.

The weight 30 is a long solid body and is greater in specific gravity than the tubular body 20. The weight 30 is provided in the periphery thereof with a ring-shaped and recessed retainer 32. The weight 30 is disposed in the tubular body 20 such that the weight 30 is put through the connection ring 26 of the connection structure 22, and that the connection ring 26 is retained in the retainer 32. The outer periphery of the weight 30 is smaller than the inner diameter of the tubular body 20 so that there is an interstice between the weight 30 and the tubular body 20, so as to enable the weight 30 to vibrate inside the tubular body 20. As the shock-absorbing device 10 of the present invention is shaken, the weight 30 is activated to vibrate, thanks to the fact that the connection portions 24 are pliable and that the weight 30 has a greater specific gravity relative to the tubular body 20.

Figure 3:
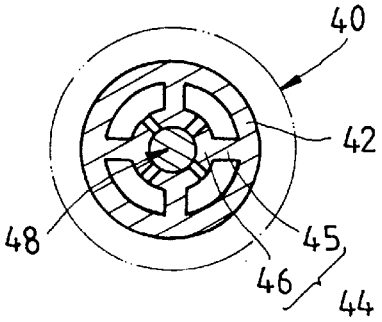
FIG. 3 shows a sectional view of a second preferred embodiment of the present invention.

As shown in FIG. 3, a shock-absorbing device 40 of the second preferred embodiment of the present invention is different from the shock-absorbing device 10 of the first preferred embodiment of the present invention in that the former is composed of a tubular body 42 having a connection structure 44 which is provided with connection portions 45. The free end of each of the connection portions 45 is connected with a wing portion 46. The wing portions 46 are not connected with one another. The wing portions 46 are secured with the periphery of the weight 48.

Figure 4:
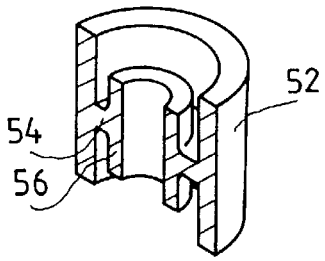
FIG. 4 shows a sectional view of a tubular body of a shock-absorbing device of a third preferred embodiment of the present invention.

Now referring to FIG. 4, the third preferred embodiment of the present invention is shown to be different from the first preferred embodiment of the present invention in that the former is composed of a tubular body 52 which is provided in the inner wall thereof with a ring-shaped connection portion 54 which is connected in the inner edge thereof with a connection ring 56 for securing the weight.

It must be added here that the connection portions 24, 45, or 54 of the present invention may be directly connected with the weight, without the use of the connection rings 26, 54 or the wing portion 46.

The shock-absorbing device 10 of the first preferred embodiment of the present invention is exemplified for use in the sporting goods having a tubular rod-shaped body 60 as shown by the imaginary lines in FIG. 1. The tubular body 20 is fastened with the inner wall of the tubular rod-shaped body 60 by an adhesive substance or other fastening means.

Figure 5:
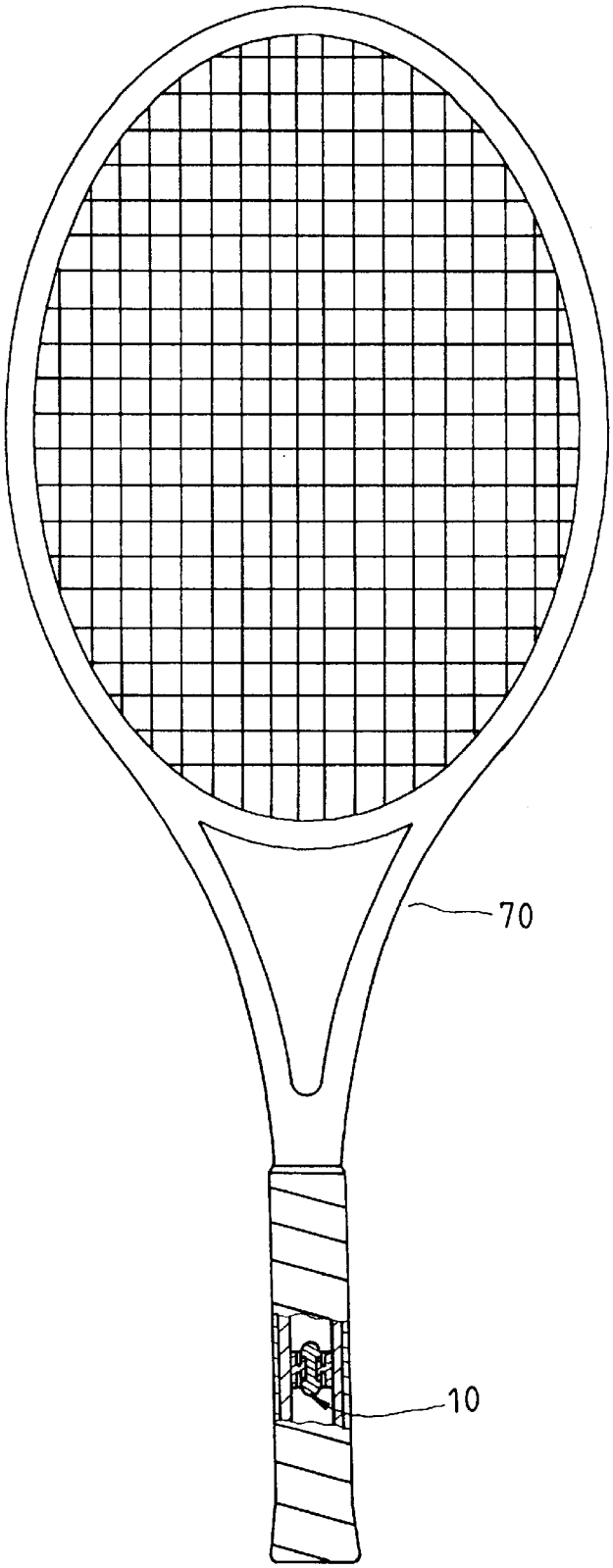
FIG. 5 shows a schematic view of the present invention in conjunction with a tennis racket.
Figure 6:
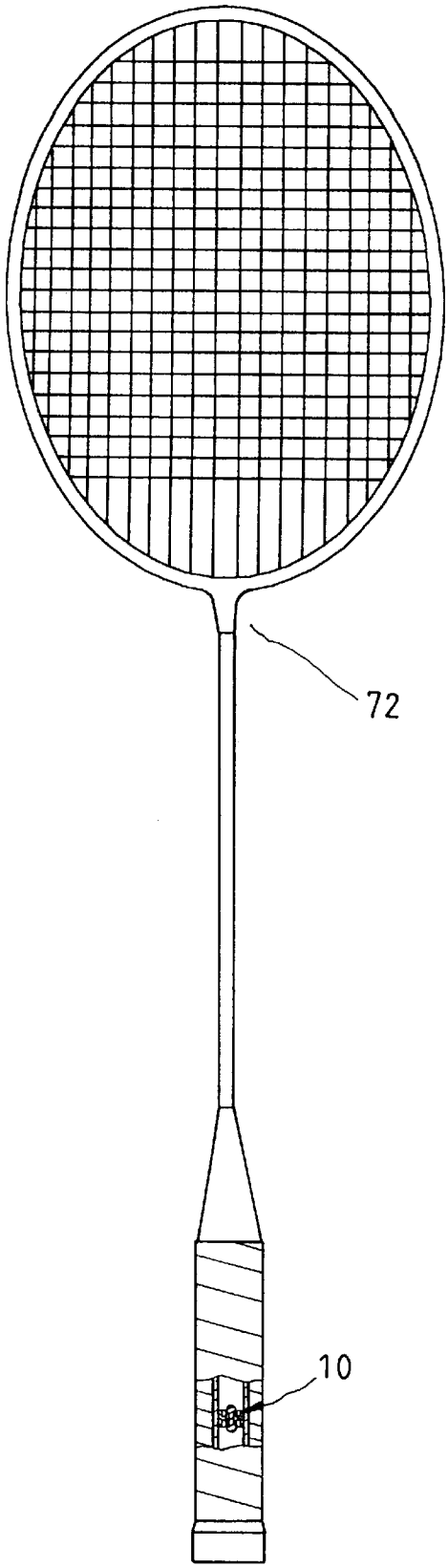
FIG. 6 shows a schematic view of the present invention in conjunction with a badminton racket.
Figure 7:
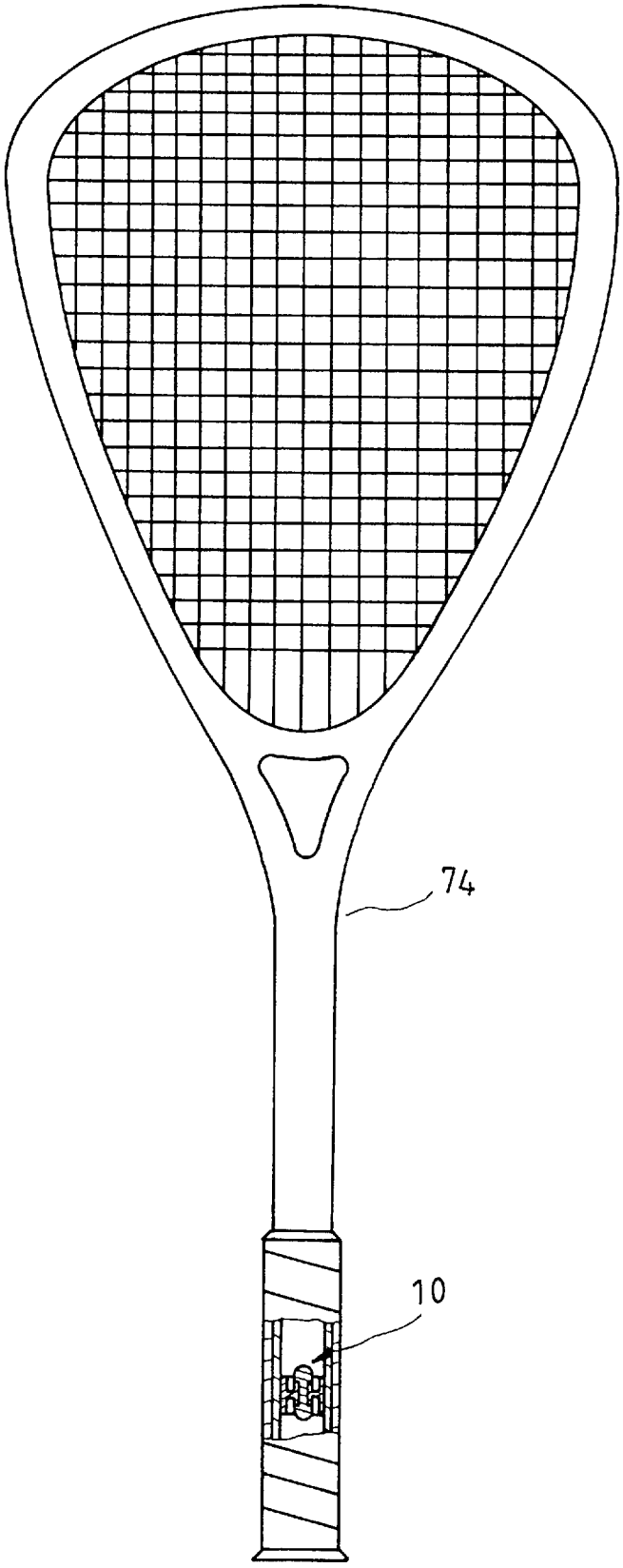
FIG. 7 shows a schematic view of the present invention in conjunction with a squash racket.
Figure 8:
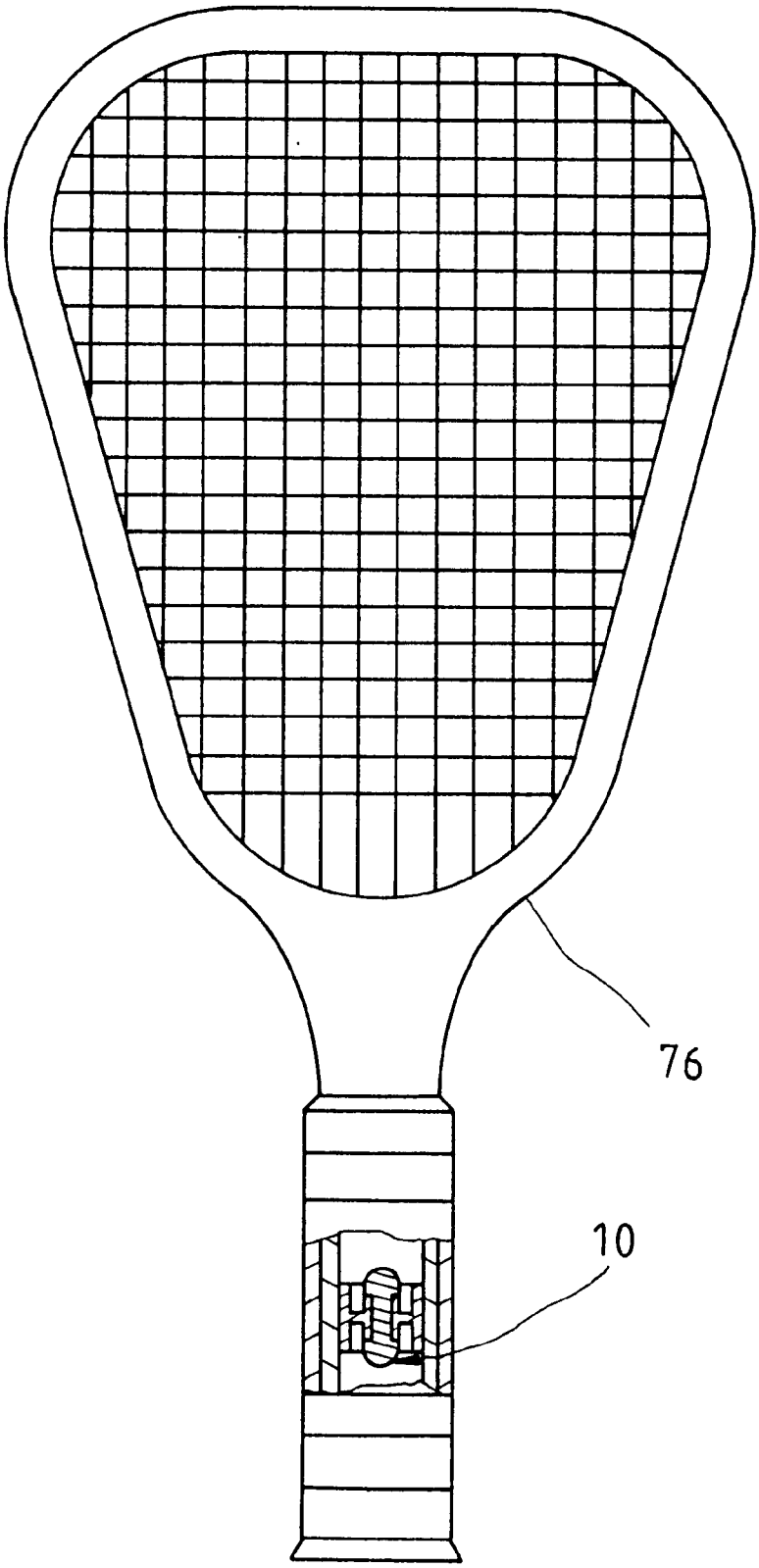
FIG. 8 shows a schematic view of the present invention in conjunction with another squash racket.
Figure 10:
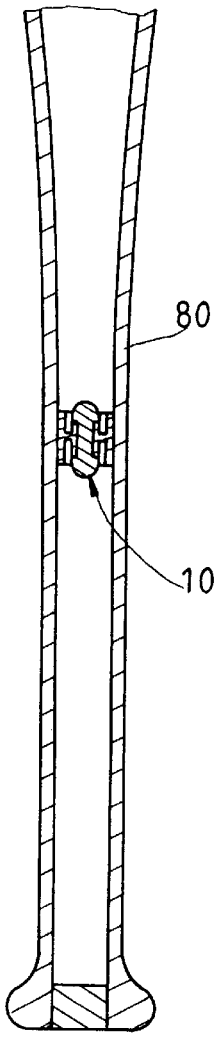
FIG. 10 shows a schematic view of the present invention in conjunction with a baseball bat.
Figure 9:
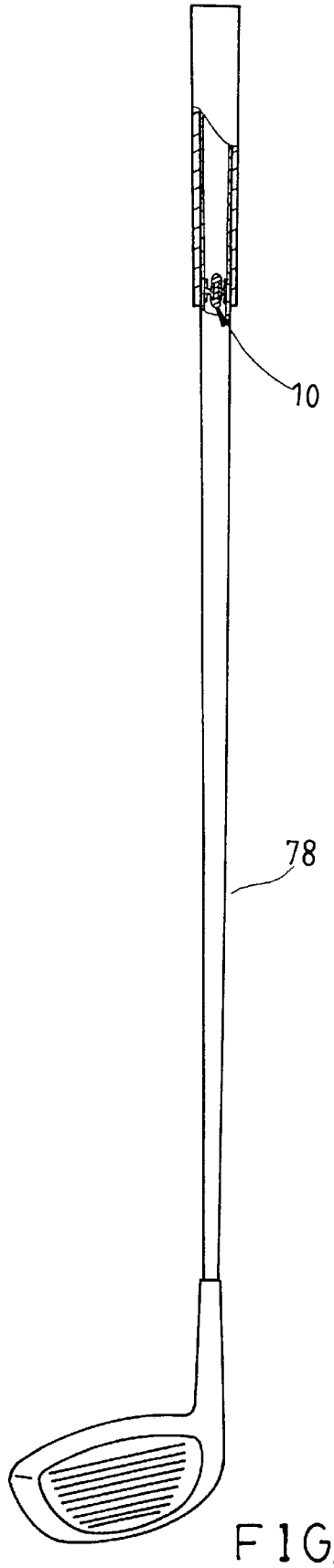
FIG. 9 shows a schematic view of the present invention in conjunction with a golf club.

The shock-absorbing device 10 is mainly disposed in the handle of the sporting goods, such as a tennis racket 70 as shown in FIG. 5, a badminton racket 72 as shown in FIG. 6, squash rackets 74 and 76 as shown in FIGS. 7 and 8, a golf club 78 as shown in FIG. 9, and a baseball bat 80 as shown in FIG. 10.

The inner wall cross section of the handle of a tennis racket, a badminton racket, or a squash racket is generally polygonal or octagonal. Accordingly, the cross section of the tubular body of the shock-absorbing device of the present invention should be also polygonal or octagonal rather than round as shown in FIG. 2.

The shock wave is brought about in the sporting goods by the impact of a ball and is then transmitted to the handle in which the shock wave is absorbed by the tubular body 20. In the meantime, as the sporting goods is shaken by the impact of the ball, the weight 30 is activated to vibrate in the tubular body 20 to cancel out the shock wave due to the vibration frequency of the weight 30 being different from the shock wave frequency. In other words, the shock-absorbing device of the present invention is capable of dual effects of shock wave absorption and shock wave cancellation. Moreover, the shock-absorbing device of the present invention can be used in various sporting goods of ballgame, as shown in FIGS. 5–10.

What is claimed is:

1. A shock absorbing device for use in ballgame goods having a tubular rod-shaped body, said device comprising:

a tubular body made of a soft elastic material and adapted to be disposed in an inner wall of the tubular rod-shaped body of the ballgame goods; and a weight disposed in said tubular body such that said weight is connected with said tubular body, and that an interstice is located between the outer surface of said weight and inner wall of said tubular body, so as to enable said weight to be activated to vibrate in said tubular body.

2. The shock absorbing device as defined in claim 1, wherein said weight is greater in specific gravity than said tubular body.

3. The shock absorbing device as defined in claim 1, wherein a periphery of said weight is provided with a connection structure for connecting said weight with said tubular body.

4. The shock-absorbing device as defined in claim 3, wherein said connection structure has a predetermined number of columnar connection portions which are arranged equidistantly in the inner wall of said tubular body.

5. The shock-absorbing device as defined in claim 4, wherein said connection structure further has a connection ring having an outer peripheral surface which is disposed on free ends of said connection portions; and wherein said weight is secured by said connection ring.

6. The shock-absorbing device as defined in claim 4, wherein said connection structure further has a plurality of wing portions which are equal in number to said connection portions and are disposed in free ends of said connection portions; and wherein said weight is secured by said wing portions.

7. The shock-absorbing device as defined in claim 3, wherein said connection structure has a hollow ring-shaped connection portion.

8. The shock-absorbing device as defined in claim 7, wherein said connection structure further has a connection ring having an outer periphery which is disposed in an inner peripheral edge of said connection portion; and wherein said weight is secured by said connection ring.

9. The shock-absorbing device as defined in claim 3, wherein said weight is provided on a periphery thereof with a retainer which is connected with said connection structure.

10. The shock-absorbing device as defined in claim 9, wherein said retainer is a recessed ring-shaped slot.

* * * * *